United States Patent [19]

Harding

[11] Patent Number: 4,628,854

[45] Date of Patent: Dec. 16, 1986

[54] SECURING INFLATABLE TUBES TO RIGID HULLS

[76] Inventor: Richard J. A. Harding, Rhiwlas Fach, Mountain Road, Trimsaran, Dyfed, South Wales, Great Britain

[21] Appl. No.: 749,830

[22] Filed: Jun. 28, 1985

[30] Foreign Application Priority Data

Jun. 29, 1984 [GB] United Kingdom ..... 84 16669

[51] Int. Cl.[4] ..... B63B 7/00

[52] U.S. Cl. ..... 114/345

[58] Field of Search ..... 114/345, 354; 441/40–42

[56] References Cited

U.S. PATENT DOCUMENTS 2,456,086 12/1948 Schwall, Jr. ..... 114/345
4,329,751 5/1982 Cigognetti ..... 114/345

FOREIGN PATENT DOCUMENTS 648431 7/1937 Fed. Rep. of Germany ..... 114/345
1589635 5/1981 United Kingdom ..... 114/345

*Primary Examiner*—Trygve M. Blix
*Assistant Examiner*—Jesûs D. Sotelo
*Attorney, Agent, or Firm*—Cushman, Darby & Cushman

[57] ABSTRACT

A boat has an inflatable buoyancy tube attached to a rigid hull by clamping an edge portion of the hull between flexible flanges secured to the tube, using comparatively rigid clamping strips. The clamping strips are pressed together by a releasable securing arrangement passing through the gunwale of the hull, for example nuts and bolts spaced along the strips. Tightenable straps anchored by the bolts may be added for extra security.

9 Claims, 9 Drawing Figures

SECURING INFLATABLE TUBES TO RIGID HULLS

BACKGROUND OF THE INVENTION

Conventionally the inflatable buoyancy tubes of a rigid-hulled inflatable boat have been secured to the top of the hull by bonding to the hull and to the tube strips of material running longitudinally along the length of the tube and hull.

In the past tubes have not normally been detachable from the hull, at least not without destruction of the joining structures, and it is an object of the present invention to provide a rigid-hulled inflatable boat of which the inflatable tube(s) is or are readily detachable from and reassemblable with the hull.

The problems faced are not only those of security but also of rendering the temporary joint fully watertight—otherwise there would be a leak path between the tube and the top of the hull.

SUMMARY OF THE INVENTION

The present invention provides a boat having an inflatable tube attached to a rigid hull, wherein an edge portion of the hull extending the longitudinal direction of the tube is clamped, by means of comparatively rigid clamping strips extending along the edge portion, between a pair of flexible flanges of the tube, securing means being provided to engage the clamping strips and press them together towards the edge portion of the hull.

The flexible flange arrangement, in addition to providing a waterproof secure attachment may, by incorporating an extra protective layer of material, provide abrasion protection of the inflatable buoyancy tube from the edge portion of the hull. The protection layer also assists prevention of peeling action where the bonded inner and outer attachment flanges leave the buoyancy tube. These flanges may thus be generally T-shaped. The protective layer and flange may form a continuous layer around the hull flange.

Preferred releasable securing means between the rigid clamping strips are nuts and bolts passing through the edge portion of the hull in which case one of the strips will preferably be provided with a recess for receiving the head of a bolt and preventing its rotation when the nut is rotated.

For double assurance one may provide once every plurality of such securing means, for example 1 in 5, that they also anchor a tightenable strap which goes round the inflatable tube and is manually tightenable onto it.

The inflatable tube may be attached and sealed to the transom of the hull by a single flexible strip secured to the tube and extending to the outside of the transom and clamped to it by a rigid strip of which the securing means engage the inner face of the transom.

BRIEF DESCRIPTION OF THE DRAWINGS

A particular embodiment of the invention will now be described by reference to the accompanying drawings wherein.

DETAILED DESCRIPTION OF THE PREFERRED EMBODIMENT

Figure 1:
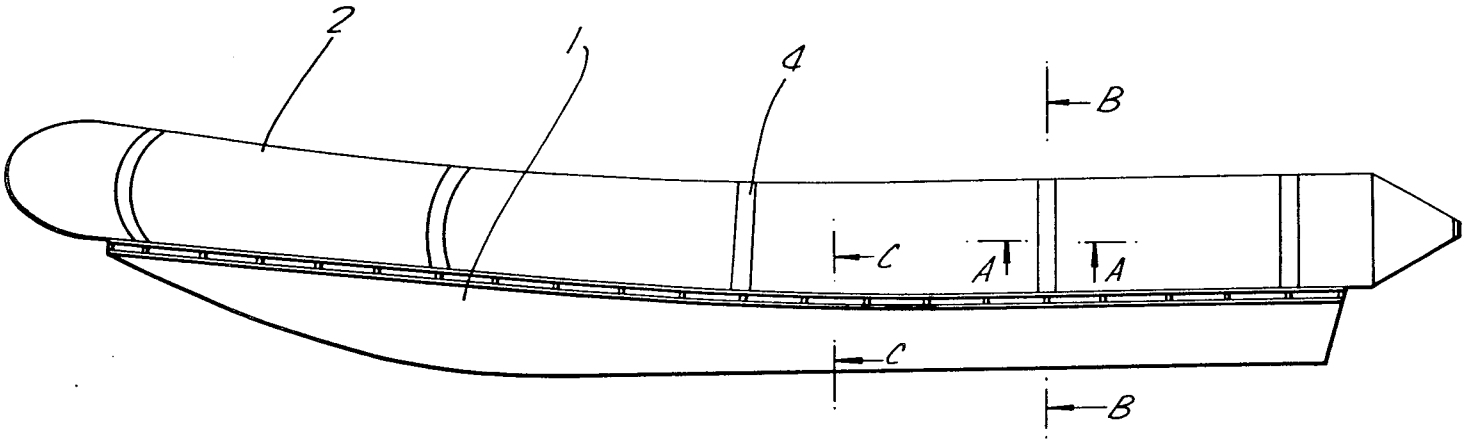
FIG. 1 is a side-view of the boat.
Figures 2, 3:
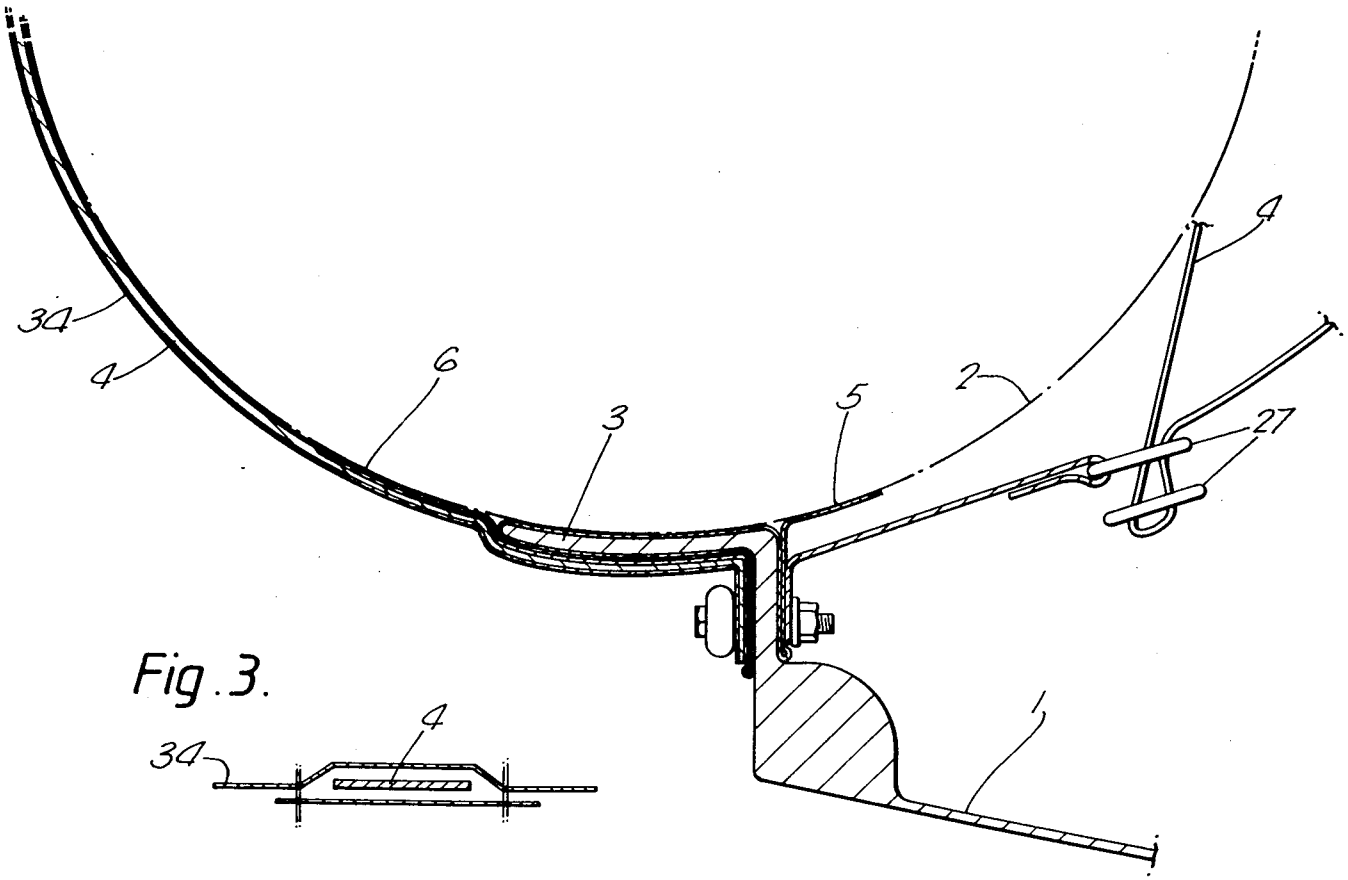
FIG. 2 is a partial section on the line BB of FIG. 1.
FIG. 3 is a partial section on the line AA of FIG. 1.
Figure 4:
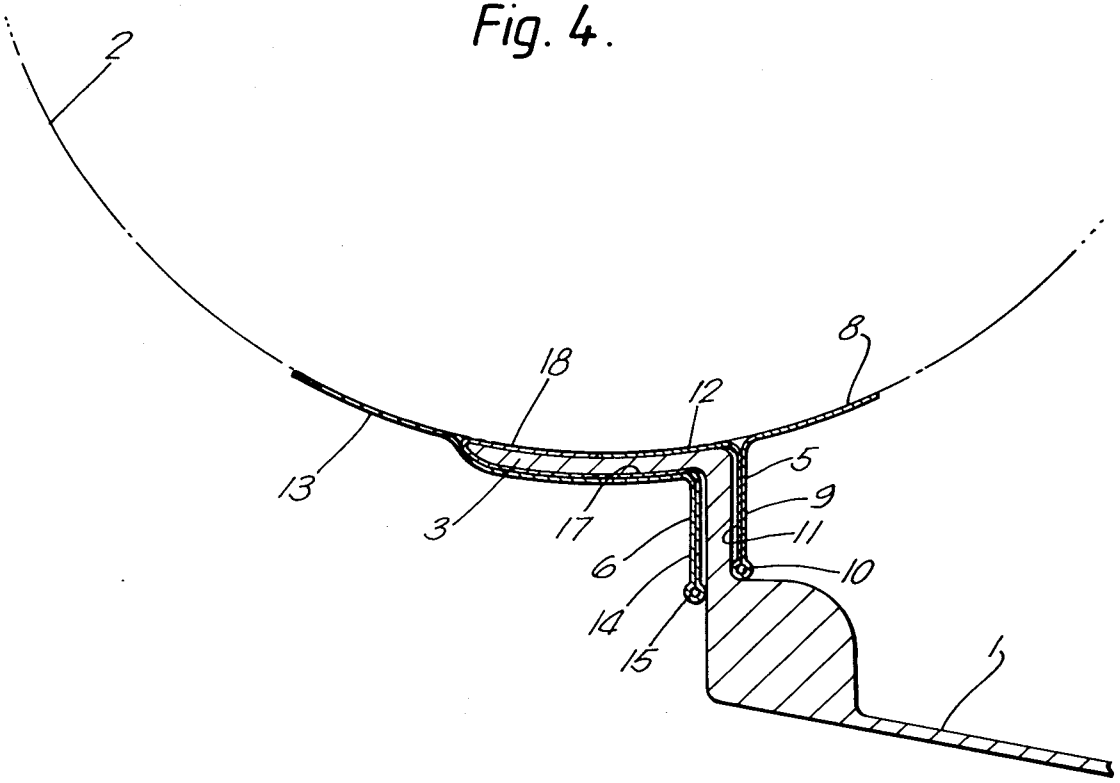
FIG. 4 is a partial section on the line CC of FIG. 1, but with the securing means removed.

The inflatable boat has a rigid hull 1 along the two sides and bow of which are arranged inflatable tube(s) 2. As is best seen in FIGS. 2 and 4, these are supported on the gunwale of the hull 1 on a flange 3. The tubes 2 are held there releasably by two separately releasable attachment means, one being a plurality of belts 4, the other being strips 5,6 which will be described in more detail.

Referring next to FIG. 4, the strips 5 and 6 run longitudinally of the hull 1 and the tubes 2 and consist of an inner double strip 5 and an outer flexible doubler strip 6 of for example, polymer coated reinforced material. The inner doubler strip 5 is permanently and securely bonded at location 8 to the tube 2 inboard of the flange 3, brought down in a run 9 round a bead wire 10 back up towards the tube in a run 11. Then, to complete its generally T-section outline, it is permanently and securely bonded to the tube 2 in a position 12 where it will be sandwiched between the tube 2 and the flange 3.

The outer doubler strip 6 is permanently and securely bonded to the tube 2 at a region 13 which will lie outboard of any part of the flange 3, is of a length to extend under the whole of the flange 3 to come down in a run 14, be doubled round a bead wire 15 back parallel to the run 14 and then brought under the flange 3 in a run 17 which lies between the main part of the strip 6 and the flange 3.

To prevent chafing and peeling an inner second thickness in the form of a hinge strip 18 is doubled around the free edge or edges of the flange 3.

Figure 5:
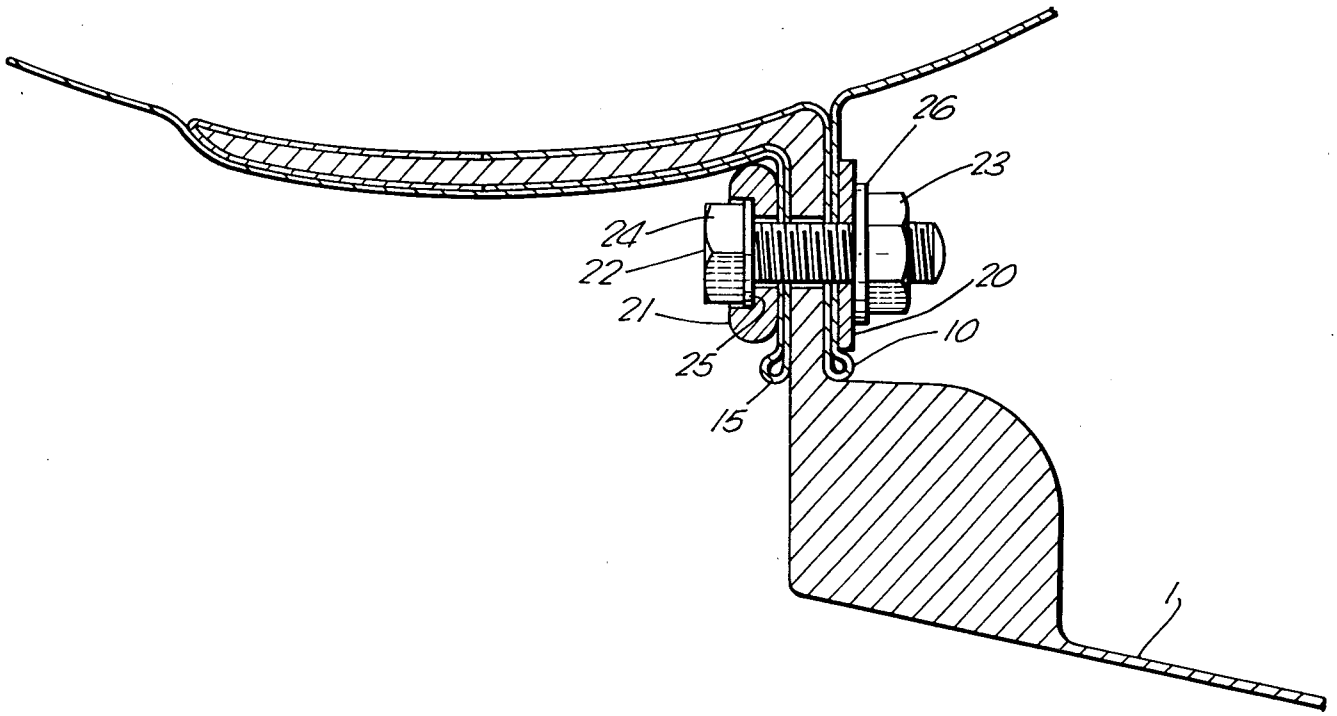
FIG. 5 is a similar section, but showing the securing means fitted.

To hold the doublers and thereby the inflated tube 2 to the hull 1, an inner rigid strip 20 and an outer comparatively rigid strip 21 suitably an aluminium extrusion, are clamped along the runs 9 and 14 of both the inner doubler strip 5 and outer doubler strip 6. As shown in FIG. 5, each strip has at regular intervals apertures which register with apertures in the hull 2 and are for the reception of securing means. Most suitably these latter securing means will be nuts 23 and bolts 22 and the outer strip 21 will be profiled such that the hexagon head 24 of the bolt 22 is received within a continuous recess in its profile so that when in position it is non-rotatable. Sealing washers 25,26 are fitted respectively below the head 24 of the bolt 22 and the nut 23 so that no leak path is available through the aperture.

Figure 6:
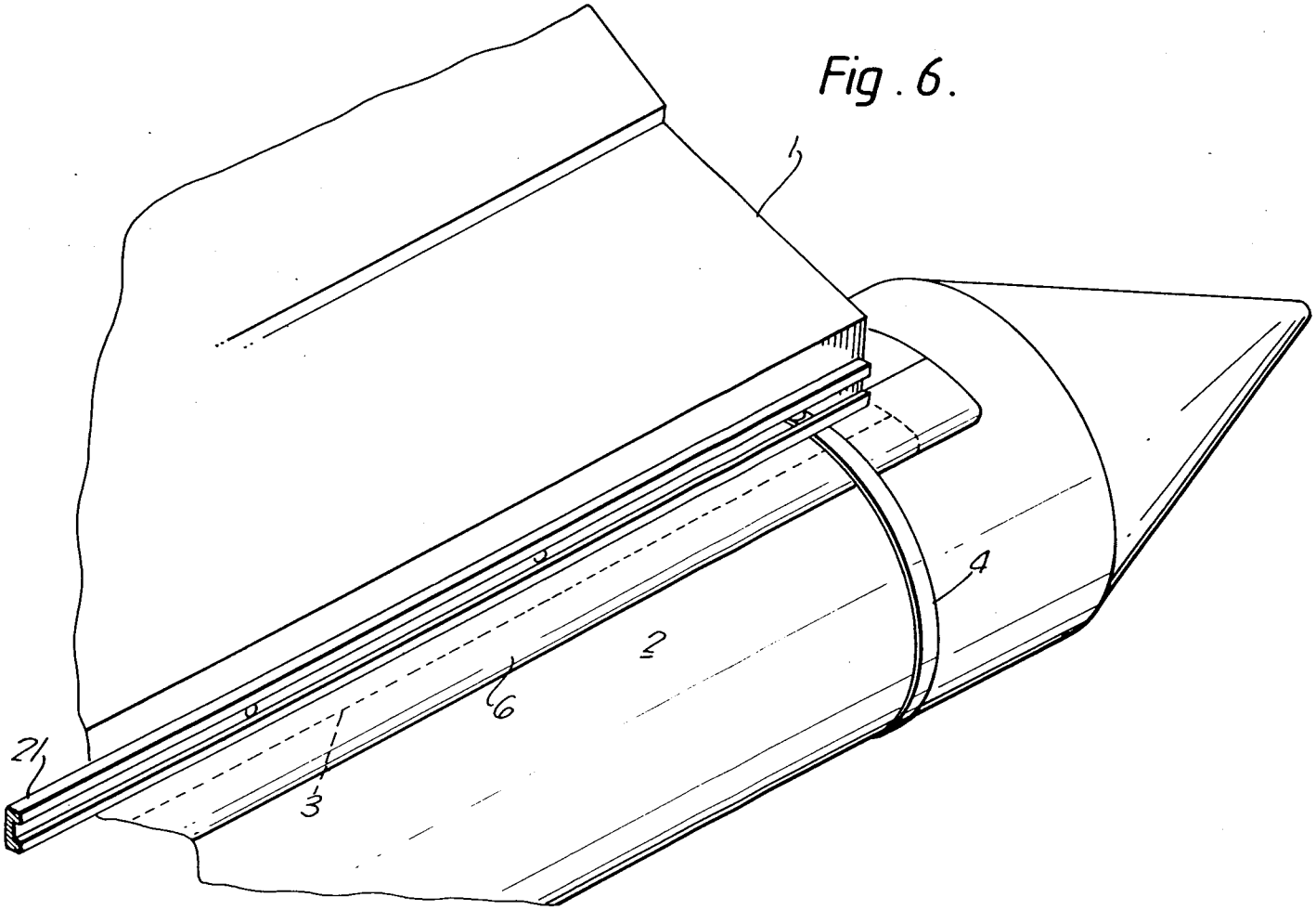
FIG. 6 is an underneath perspective view of one side of the boat.

As shown in FIG. 6, the straps 4 are entrapped also beneath the strips 20,21 every so often along the length of the boat—for example every fifth nut and bolt. These are webbing straps 4, one end being secured outboard of the gunwale of the hull 1, the shorter end being secured inboard. Sleeves 34, constructed generally as seen in FIG. 3, may be provided to retain the straps 4 approximately in position on the inflatable tube 2. The straps 4 are tightenable from inside the boat by having the free end of one of the parts being pulled through a two-bar or three-bar buckle assembly 27 of conventional type.

Figure 7:
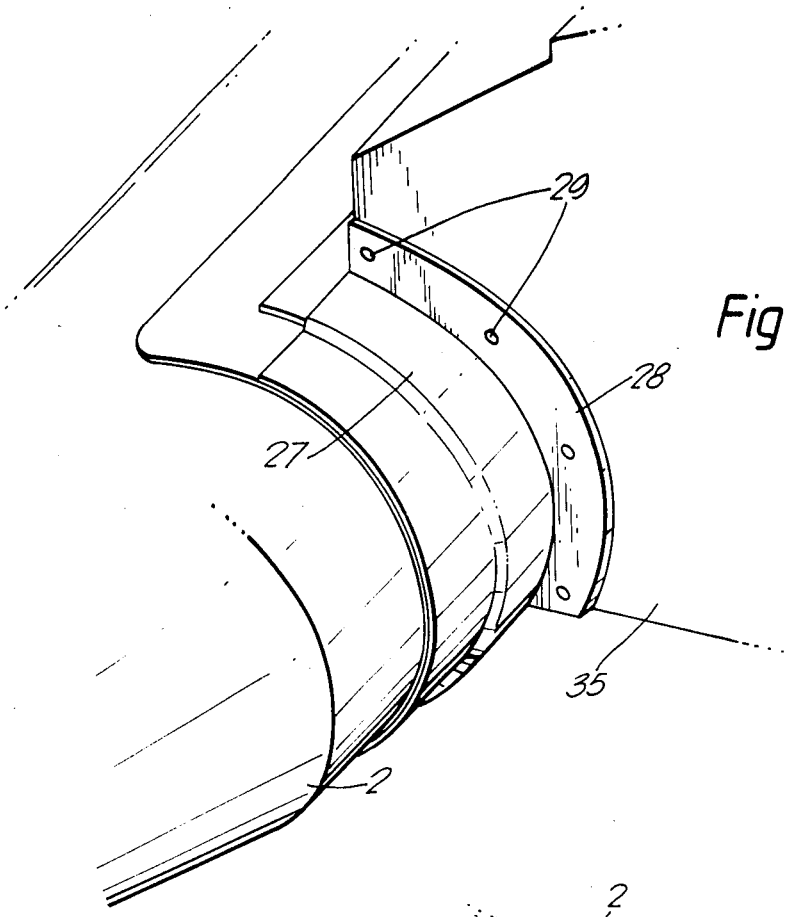
FIGS. 7 and 8 show details of the attachment of the tube to the transom.
Figure 8:
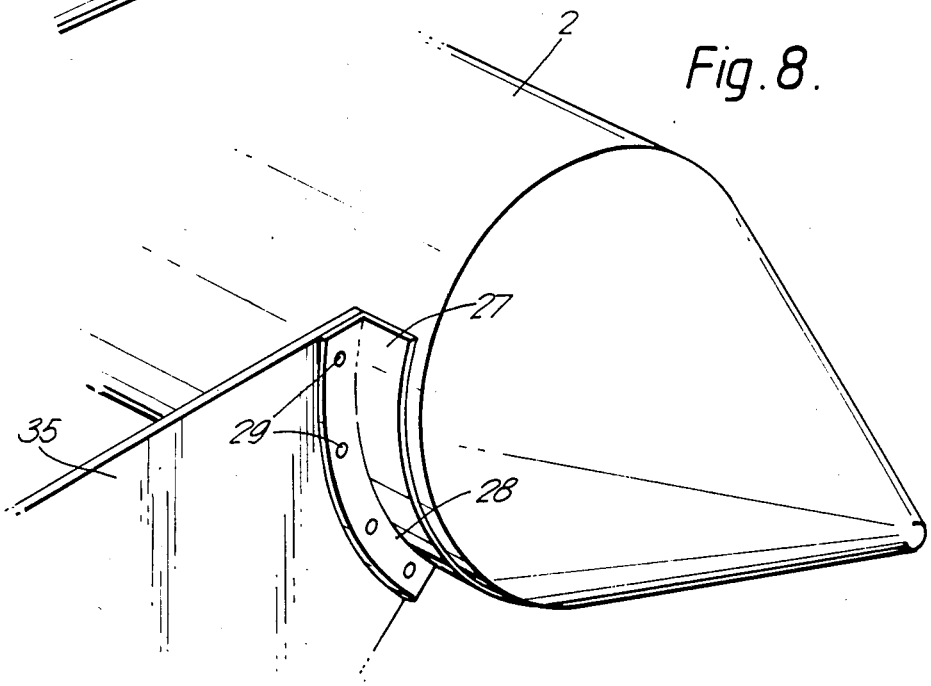
Figure 9:
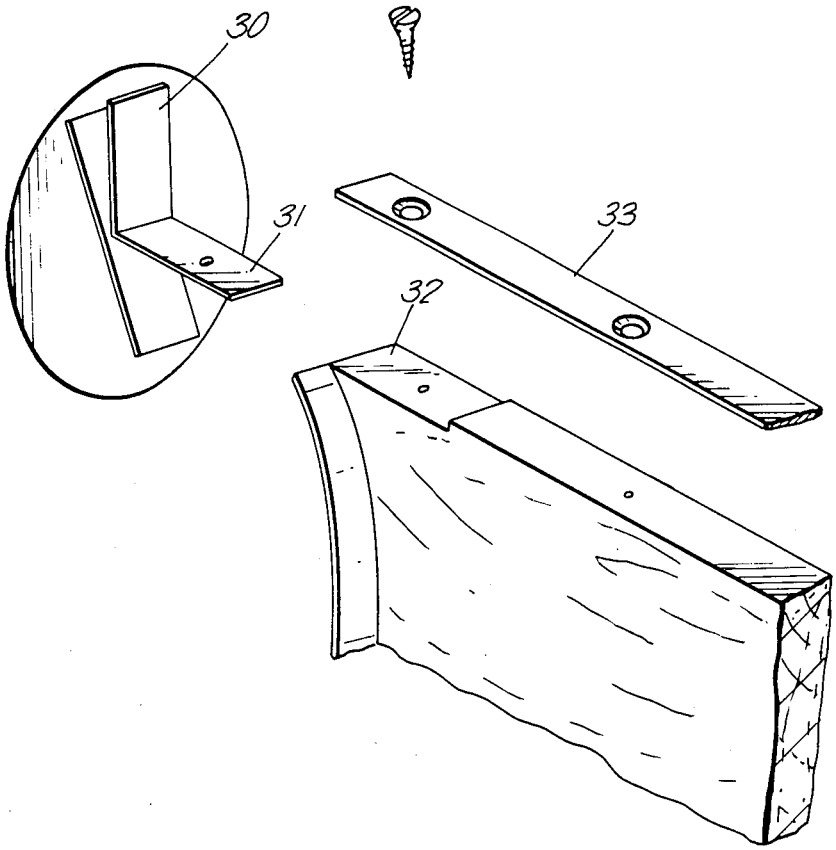
FIG. 9 shows further detail of the attachment of the tube to the transom.

At the transom of the boat, a similar removable attachment is used and is seen in FIGS. 7,8 and 9.

To secure the tube 2 to the vertical wall 35 of the transom, a single strip 27 is provided on the outboard side, secured to the inflatable tube 2 as before and turned onto the planar wall of the transom to be held there by a metal clamping strip 28 bolted to the transom by nuts and bolts passed through bores 29. On the top surface of the transom shown in FIG. 9, a webbing hinge 30 has one arm glued to the tube and has its other arm 31 tucked into a recess 32 on the top transom edge where it is held by being pressed on by a capping strip 33 screwed onto the top of the transom.

It can be seen that a strong leakproof structure and very readily releasable securing means has been provided whereby the tubes are attachable or detachable at will.

I claim:

1. A boat comprising:

an inflatable tube having a generally longitudinal direction and an external surface;

a plurality of flexible flanges on the external surface of said tube and extending longitudinally thereof;

a rigid hull having an edge portion formed with an upright portion and a rigid flange portion arranged substantially perpendicular to the upright portion, said upright portion being positioned between said flexible flanges of said tube and said rigid flange portion having an upper surface; and clamping means arranged between said tube and said hull, said clamping means comprising elongate clamping strips and securing means, said securing means penetrating said upright portion of the hull and drawing said clamping strips together, thereby clamping said flexible flanges and said upright portion between said clamping strips;

whereby the inflatable tube conforms generally with the shape of the upper surface of the rigid flange portion between the flexible flanges.

2. A boat according to claim 1, wherein said securing means comprise bolts spaced longitudinally along said clamping strips, said bolts passing through said clamping strips, said flexible flanges and said upright portion of the hull.

3. A boat according to claim 2 wherein at least one of said clamping strips has a recess, said recess receiving a head of at least one of said bolts and preventing rotation of said head.

4. A boat according to claim 1, wherein there is a layer of flexible material secured to and extending along said tube, said layer having at least one projecting doubled longitudinal fold forming at least one of said flexible flanges.

5. A boat according to claim 4, wherein said layer of flexible material forming said flexible flange is substantially T-shaped in cross-section.

6. A boat according to claim 5, having a protective layer of material between said edge portion of said hull and said tube.

7. A boat according to claim 6, wherein said flexible flanges and said protective layer form a continuous layer around said edge portion of said hull.

8. A boat according to claim 1, having a protective layer of material between said edge portion of said hull and said tube.

9. A boat according to claim 1, having manually tightenable securing straps anchored by said securing means and passing around said tube.

* * * * *